US009842524B2

(12) United States Patent
You

(10) Patent No.: US 9,842,524 B2
(45) Date of Patent: Dec. 12, 2017

(54) DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventor: Shuai You, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 140 days.

(21) Appl. No.: 14/694,966

(22) Filed: Apr. 23, 2015

(65) Prior Publication Data

US 2015/0310786 A1 Oct. 29, 2015

(30) Foreign Application Priority Data

Apr. 23, 2014 (CN) ..... 2014 1 0165640

(51) Int. Cl.
*G09G 3/00* (2006.01)
*G09G 5/02* (2006.01)

(52) U.S. Cl.
CPC ..... *G09G 3/006* (2013.01); *G09G 5/02* (2013.01); *G09G 2320/0204* (2013.01); *G09G 2320/029* (2013.01); *G09G 2320/0247* (2013.01); *G09G 2330/04* (2013.01)

(58) Field of Classification Search
None
See application file for complete search history.

(56) References Cited

U.S. PATENT DOCUMENTS 7,817,217 B2 * 10/2010 Lee ..... H01L 27/0248 349/40
2006/0232577 A1 * 10/2006 Edwards ..... G09G 3/3648 345/211
2007/0268420 A1 * 11/2007 Tsai ..... G02F 1/13452 349/40
2010/0033413 A1 2/2010 Song et al.
2010/0073009 A1 * 3/2010 Wang ..... G09G 3/006 324/537
2011/0291098 A1 * 12/2011 Hayafuji ..... G09G 3/006 257/59
2013/0307548 A1 * 11/2013 Lee ..... H01L 27/124 324/414

FOREIGN PATENT DOCUMENTS

CN 102568406 A 7/2012

* cited by examiner

*Primary Examiner* — Paresh Patel
(74) *Attorney, Agent, or Firm* — Anova Law Group, PLLC

(57) ABSTRACT

A display device is disclosed. The display device includes a first display test signal inputting part, configured to input a first display test signal. The display device also includes a first display test signal controlling part, configured to control the input of the first display test signal. The display device also includes a second display test signal inputting part, configured to input a second display test signal. The display device also includes a first test bus, connected to the first display test signal inputting part. The display device also includes a second test bus, connected to the second display test signal inputting part, where the first test bus and the second test bus are connected with each other.

14 Claims, 3 Drawing Sheets

DISPLAY DEVICE

CROSS-REFERENCES TO RELATED APPLICATIONS

This application claims the benefit of priority to Chinese Patent Application No. 201410165640.8, filed with the Chinese Patent Office on Apr. 23, 2014 and entitled "DISPLAY DEVICE", the content of which is incorporated herein by reference in its entirety.

TECHNICAL FIELD

The present invention relates to the field of display, and in particularly to a display device.

BACKGROUND OF THE INVENTION

Recently, Liquid Crystal Display (LCD) products develop very rapidly, and more and more liquid crystal displays with high quality gradually list in the market and are applied in wider fields.

The principle for displaying images by a liquid crystal display is that: liquid crystal are deflected by a certain angle to pass light through when a voltage is applied across two plates sandwiching the liquid crystals, and the light transmissivity of the liquid crystal depends on the size of the deflected angle of the liquid crystal, thus different gray scales are displayed.

However, the electrical potential at a common electrode is fixed during the displaying period of the liquid crystal display, and the layer of the liquid crystal is equivalent to a capacitor. When a Driver Integrated Circuit (Driver IC) is illuminated by light and then a photovoltaic effect is caused in the Driver IC, carriers such as electrons generated by the photovoltaic effect enter into a data line and change electrical charges in the data line, and hence electrical charges at a pixel electrode and the common electrode are changed, at this time, a voltage across the pixel electrode and the common electrode is changed, so that a second voltage generated by the photovoltaic effect is formed across the pixel electrode and the common electrode to form an electrical field, the electrical field is caused by residual ions and thus also referred to as a residual electrical field. When the LCD emits light again, the original symmetrical voltage applied across the pixel electrode and the common electrode is applied in combination with such residual electrical field in the LCD, resulting in an asymmetrical voltage applied in the LCD, and the asymmetrical voltage will lead to flicker of the LCD. For now, the photovoltaic effect may be prevented by a shading tape (or a black tape); but after attaching of cover lens onto a capacitance touch screen becomes popular, the shading tape is abandoned, instead, an opaque area is designed on the cover lens of the capacitance touch screen to shield light. However, in producing and manufacturing the LCD, the opaque area on the cover lens cannot shield light very well, thus the photovoltaic effect still exists and causes a negative effect to the display quality.

DETAILED DESCRIPTION OF THE PREFERRED EMBODIMENTS

Figure 1:
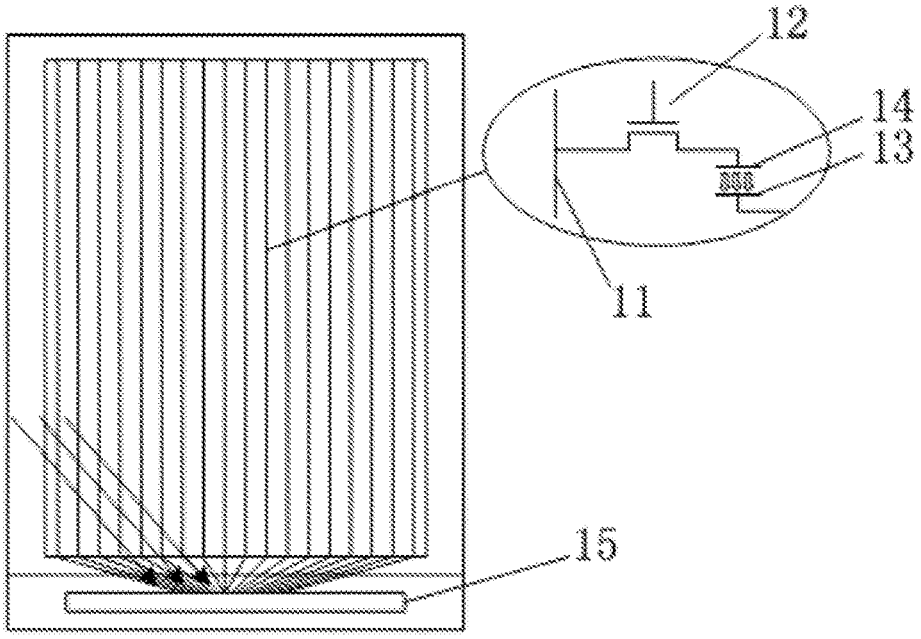
FIG. 1 (Prior Art)
FIG. 1 is a schematic view showing a structure of a display device in the related art.

The present invention will be further described in detail in combination with accompanied drawings and embodiments. It is understood that embodiments described herein are merely used to explain the present invention but not to limit the present invention. It is additionally noted that only a part of not all of the structures relevant to the present invention is illustrated in the drawings.

A display device disclosed by embodiments of the present invention includes an LCD device, an Organic Light Emitting Diode (OLED) display device, etc., and description here is made with a liquid crystal display device as an example. The liquid crystal display device includes a liquid crystal display panel and a flexible printed circuit board bounded with the liquid crystal display panel, wherein the liquid crystal display panel includes a Thin Film Transistor (TFT) array substrate and a color filter substrate disposed opposite to the TFT array substrate and liquid crystal encapsulated between the TFT array substrate and the color filter substrate. The TFT array substrate includes a plurality of data lines and a plurality of gate lines perpendicular to and electrically insulated from the data lines, both of data lines and the gate lines are configured to control TFT switches of all sub-pixels in combination with control signals, where a source of the TFT switch is connected to the data line, a gate of the TFT switch is connected to the gate line, and a drain of the TFT switch is connected to a pixel electrode in the TFT array substrate; additionally, the TFT array substrate also includes a common electrode (the common electrode may be located in a different position depending on the different type of the display panel, for example, the common electrode is disposed at the side of the color filter substrate in a Twisted Nematic display panel, and is disposed at the side of the TFT array substrate in an In-Plane Switching display panel or a Fringe Field Switching display panel), and a driver integrated circuit configured to provide a data signal to each one of the sub-pixels of the TFT array substrate.

Figure 2:
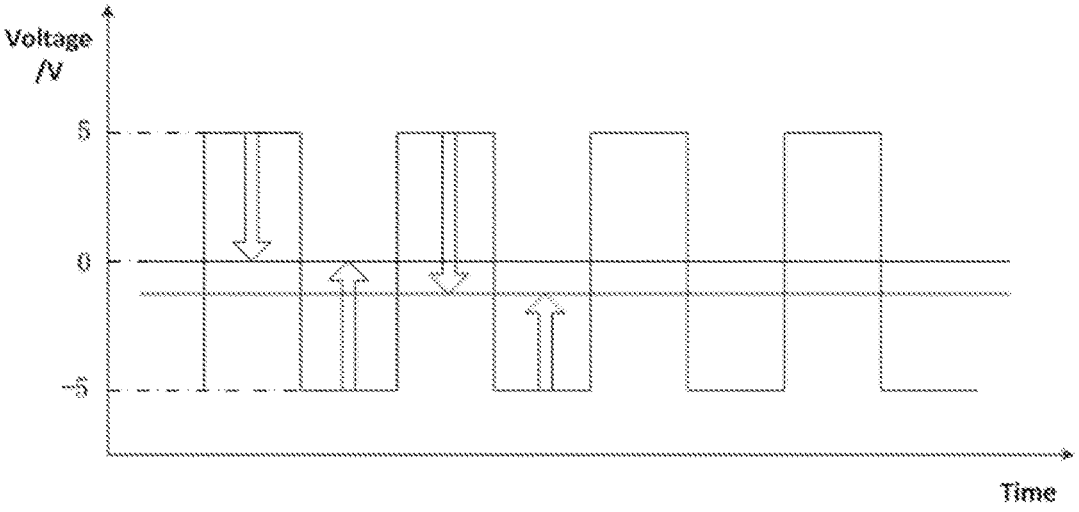
FIG. 2 (Prior Art)
FIG. 2 is a schematic view showing an effect of a residual direct current (DC) voltage due to the presence of the photovoltaic effect in the display device in the related art.

FIG. 1 is a schematic view showing a structure of a display device in the related art. As illustrated in FIG. 1, when a driver integrated circuit 15 is illuminated by light, carries such as electrons generated in the driver integrated circuit 15 by the photovoltaic effect enter into a data line 11 and change electrical charges in the data line 11; further, if a TFT switch 12 is controlled to be turned on, electrical charges at a pixel electrode 14 and a common electrode 13 are changed, leading to the change of a voltage across the pixel electrode 14 and the common electrode 13, so that a second voltage generated by the photovoltaic effect is formed across the pixel electrode 14 and the common electrode 13. The liquid crystal actually contains various electrical charges, the electrical charges are directionally moved under the effect of the second voltage, thus residual charges are attached finally at the side of the pixel electrode 14 and the side of the common electrode 13 over time, respectively, and the residual charges attached at the side of the pixel electrode 14 and those attached at the common electrode 13 are electrically inversed. Therefore, an electrical field is formed between the pixel electrode 14 and the common electrode 13, and this electrical field, which is formed by the residual charges, is also referred to as a residual electrical field. FIG. 2 is a schematic view showing an effect of the residual DC voltage of the residual electrical field caused by the photovoltaic effect of the display device in the related art. As illustrated in FIG. 2, when the LCD emits light again, the original voltage of 5V or −5V (which is an example, not necessarily the real value of the second voltage) to be applied to the pixel electrode and the common electrode is applied in the LCD in combination with the residual voltage of the residual electrical field, for example, if the residual DC voltage is 0.2V, the resultant positive voltage of 5.2V and the resultant negative voltage of −4.8V, such asymmetric voltages will cause the flicker of the LCD.

Figure 3:
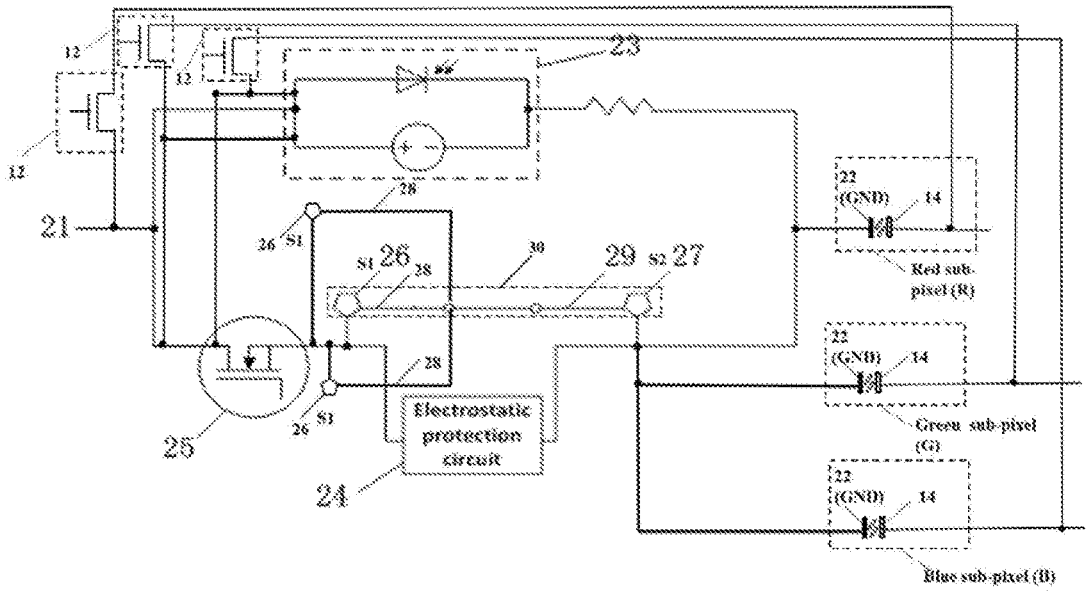
FIG. 3 is a schematic view showing a circuit in a display device according to an embodiment of the present invention.

FIG. 3 is a schematic view showing a circuit in a display device according to an embodiment of the present invention, and the display device further includes a display panel including: a first display test signal inputting part 26, a first display test signal controlling part 25, a second display test signal inputting part 27, a first test bus 28, and a second test bus 29.

The first display test signal inputting part 26 is configured to input a first display test signal.

In the present embodiment, the first display test signal inputting part 26 can be a pixel test bonding pad 26 configured to input a sub-pixel test signal.

The first display test signal controlling part 25 is configured to control the input of the first display test signal.

In the present embodiment, the first display test signal inputting part 26 is controlled by the first display test signal controlling part 25. The first display test signal controlling part 25 may be an N-channel metal oxide semiconductor (NMOS) transistor, which may be controlled to be turned on or off such that different first display test signals respectively corresponding to sub-pixels of different colors may be inputted by the first display test signal inputting part 26. Here, the first display test signal controlling part 25 is configured to switch among the first display test signals S1 corresponding to the sub-pixels of different colors. The first display test signals S1 contain a group of signals which are connected together via NMOS transistors for the purpose of testing. For example, as per colors of the sub-pixels, one test bonding pad is provided for each of red (R), green (G) and blue (B) sub-pixels, and all of the first display test signals S1 may be controlled by controlling the signals received by the gates of the NMOS transistors, without adding many signal lines.

The second display test signal inputting part 27 is configured to input a second display test signal S2.

In the present embodiment, the second display test signal inputting part 27 (such as a common electrode test bonding pad 27 illustrated in FIG. 3) is connected to a common electrode 22 of the display panel and configured to input a common electrode test signal.

The first test bus 28 is connected to the first display test signal inputting part 26.

The second test bus 29 is connected to the second display test signal inputting part 27.

The first test bus 28 and the second test bus 29 both included in the display panel are connected with each other by a short-circuit connection 30.

In the present embodiment, the first display test signal inputting part 26 is connected to the second display test signal inputting part 27 by a short-circuit connection 30 in the display panel via the first test bus 28 and the second test bus 29. As illustrated in FIG. 3, the pixel test bonding pad 26 is connected to the common electrode test bonding pad 27 by a short-circuit connection 30 in the display panel.

It is noted that, as illustrated in FIG. 3, the first display test signal controlling part 25 and the first display test signal inputting part 26 are connected to the common electrode 22 via an electrostatic protection circuit 24, for an electrostatic protection effect on the first display test signal controlling part 25 and the first display test signal inputting part 26.

As illustrated in FIG. 3, when a driver integrated circuit 23 is illuminated by light so that the photovoltaic effect is caused and hence a DC voltage is produced across the common electrode 22 and a data line 21, the DC voltage is directly applied to a pixel and thus generates photovoltaic current due to weak ON status of the amorphous-silicon thin-film transistor (A-Si TFT) (i.e. the TFT switch 12 as shown in FIG. 1). However, electrical charges generated by the photovoltaic effect may be conducted to a grounding terminal (GND) (e.g. the common electrode 22) through the connection between the pixel test bonding pad and the common electrode test bonding pad, due to weak ON status of the first display test signal controlling part 25 (such as an NMOS transistor).

In the present embodiment, the first display test signal inputting part 26 and the second display test signal inputting part 27 are connected with each other to release the photovoltaic current, so that the influence caused on the display effect by the residual direct current generated by the photovoltaic effect of the driver integrated circuit or the amorphous-silicon thin-film transistor is reduced.

In the present embodiment, there may be a plurality of the first display test signal inputting parts 26, the number of which corresponds to the number of base colors of the display device; further, there may be a plurality of the first test buses 28, including test buses for sub-pixels of the respective base colors, and the plurality of the first display test signal inputting parts are respectively connected to the test buses for sub-pixels of the respective base colors.

In the present embodiment, the base colors of the display device included (R), green (G) and blue (B) colors. Most colors can be formed by a red color, a green color and a blue color synthesized in various proportions. These three base colors are independent of each other, and any one of the base colors cannot be formed by other two base colors. Therefore, the plurality of the first display test signal inputting parts 26 may include three test signal inputting parts respectively for these three different colors, likewise, the plurality of the first test buses 28 may include three test buses respectively for pixels of these three different colors, and each one of the three test signal inputting parts from the plurality of the first display test signal inputting parts 26 is connected to one of the test buses for a pixel (which is of the same color as the one of the three test signal inputting parts) from the first test buses 28.

In the present embodiment, the plurality of the first display test signal inputting parts 26 may include a red sub-pixel test signal inputting part, a green sub-pixel test signal inputting part and a blue sub-pixel test signal inputting part, the plurality of the first test buses 28 may include a red sub-pixel signal test bus, a green sub-pixel signal test bus and a blue sub-pixel signal test bus, which are respectively connected to the red sub-pixel test signal inputting part, the green sub-pixel test signal inputting part and the blue sub-pixel test signal inputting part.

In the present embodiment, the second display test signal inputting part 27 may include a common electrode test signal inputting part.

In the present embodiment, the first display test signal controlling part 25 can be an NMOS transistor, a source of which is connected to the first display test signal inputting part 26, and a gate of which is configured to receive a first control signal to turn on or off the NMOS transistor; and the first display test signal inputting part 26 is connected to the common electrode test signal inputting part. When the display device is in displaying, the first control signal is at a low level, such that the NMOS transistor is turned off; and when the display device stops displaying, the first control signal is at a high level, such that the NMOS transistor is turned on.

In the present embodiment, the NOMS transistor (as illustrated in FIG. 3) is used as a switch to control the input of the first display test signal. The source of the NMOS transistor is connected to the pixel test bonding pad, the drain of the NMOS transistor is connected to the data line 21, and the gate of the NMOS transistor is configured to receive the first control signal, so that the influence caused on the display device in an inactive state by the photovoltaic effect is reduced. When the display device is in displaying, a negative voltage is applied to the gate of the NMOS transistor to turn off the NMOS transistor, i.e. the source of the NMOS transistor is disconnected from the drain of the NMOS transistor. At this time, the data line 21 can still be normally driven without impact from the NMOS transistor. When the display device stops displaying, a potential at the gate of the NMOS transistor is maintained to be zero, and the NMOS transistor is still turned on when the voltage VGS across the gate and the source of the NMOS transistor is 0, such that electrical charges generated by the photovoltaic effected may be conducted to the GND terminal via the path of the NMOS transistor.

Figure 4:
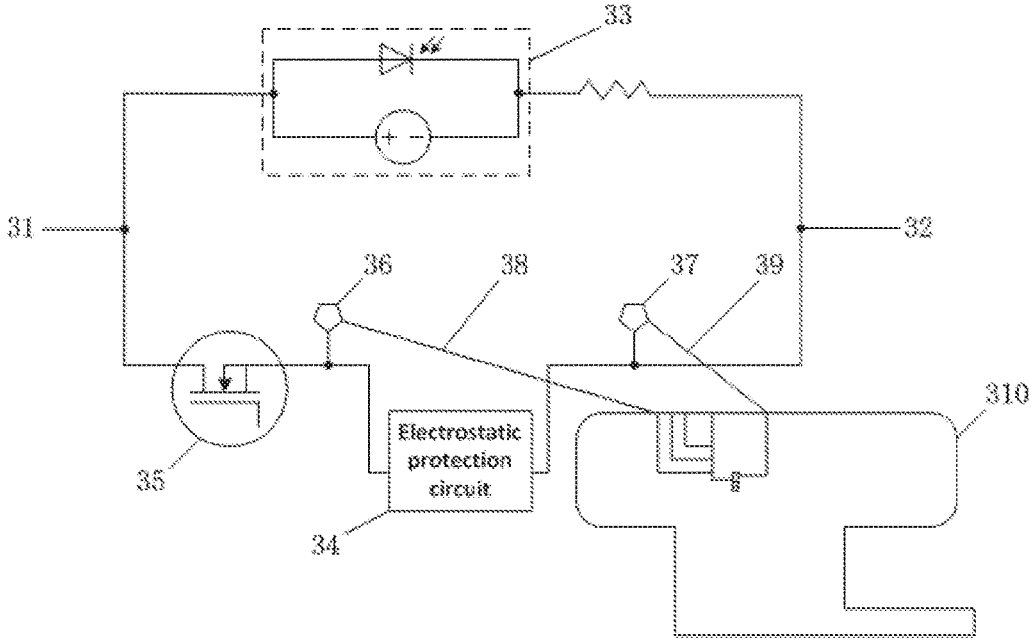
FIG. 4 is a schematic view showing a circuit in a display device according to another embodiment of the present invention.

FIG. 4 is a schematic view showing a circuit of a display device according to another embodiment of the present invention, and the display device includes: a first display test signal inputting part 36, a first display test signal controlling part 35, a second display test signal inputting part 37, a first test bus 38, and a second test bus 39.

The first display test signal inputting part 36 is configured to input a first display test signal.

In the present embodiment, the first display test signal inputting part 36 may be a pixel test bonding pad which is configured to input a sub-pixel test signal.

The first display test signal controlling part 35 is configured to control the input of the first display test signals.

In the present embodiment, the first display test signal inputting part 36 is controlled by the first display test signal controlling part 35, the first display test signal controlling part 35 can be an NMOS transistor. By controlling the NMOS transistor to be turned on or off, different first display test signals are input by the first display test signal inputting part 36.

The second display test signal inputting part 37 is configured to input a second display test signal.

In the present embodiment, the second display test signal inputting part 37 (such as a common electrode test bonding pad illustrated in FIG. 4) is connected to a common electrode 32 of the display panel and configured to input a common electrode test signal.

The first test bus 38 is connected to the first display test signal inputting part.

The second test bus 39 is connected to the second display test signal inputting part.

The display device further includes a flexible printed circuit board 310, the flexible printed circuit board 310 includes the first test bus 38 and the second test bus 39 connected with each other by a short-circuit connection. In the present embodiment, the first display test signal inputting part 36 (such as a pixel test bonding pad as illustrated in FIG. 4) and the second display test signal inputting part 37 (such as the common electrode test bonding pad as illustrated in FIG. 4) are connected to the flexible printed circuit board 310 in the display device, and are connected with each other by a short-circuit connection via a conductive line on the flexible printed circuit board 310.

It is noted that, as illustrated in FIG. 4, the first display test signal controlling part 35 and the first display test signal inputting part 36 are connected to the common electrode 32 via an electrostatic protection circuit 34, to achieve an electrostatic protection effect on the first display test signal controlling part 35 and the first display test signal inputting part 36.

In the present embodiment, there may be a plurality of the first display test signal inputting parts 36, the number of the first display test signal inputting parts 36 corresponds to the number of base colors of the display device; there may be a plurality of the first test buses 38, including test buses for sub-pixels of the respective base colors, and the plurality of the first display test signal inputting parts are respectively connected to the test buses for sub-pixels of the respective base colors.

In the present embodiment, the plurality of the first display test signal inputting parts 36 may include a red sub-pixel test signal inputting part, a green sub-pixel test signal inputting part and a blue sub-pixel test signal inputting part, and the plurality of the first test buses 38 may include a red sub-pixel signal test bus, a green sub-pixel signal test bus and a blue sub-pixel signal test bus, which are respectively connected to the red sub-pixel test signal inputting part, the green sub-pixel test signal inputting part and the blue sub-pixel test signal inputting part.

In the present embodiment, the second display test signal inputting part 37 may include a common electrode test signal inputting part.

In the present embodiment, the first display test signal controlling part 35 can be an NMOS transistor, a source of which is connected to the first display test signal inputting part 36, and a gate of which is configured to receive a first control signal to turn on or off the NMOS transistor; and the first display test signal inputting part 36 is connected to the common electrode test signal inputting part. When the display device is in displaying, the first control signal is at a low level, such that the NMOS transistor is turned off; and when the display device stops displaying, the first control signal is at a high level, such that the NMOS transistor is turned on.

As illustrated in FIG. 4, when a driver integrated circuit 33 is illuminated by light so that the photovoltaic effect is caused and hence a DC voltage is produced across the common electrode 32 and a data line 31, the DC voltage is directly applied to a pixel and thus generates photovoltaic current due to weak ON status of the amorphous-silicon thin-film transistor. However, the first display test signal inputting part 36 and the second display test signal inputting part 37 are connected to the flexible printed circuit board 310 and connected with each other by a short-circuit connection, and the NMOS transistor becomes weak ON status in the inactive state of the display device, so that the electrical charges generated by the photovoltaic effect are guided to the GND terminal via the path through the first display test signal inputting part 36 and the second display test signal inputting part 37, thus reducing the influence caused on the display effect by the residual direct current generated by the photovoltaic effect of the driver integrated circuit 33 or the amorphous-silicon thin-film transistor.

In an optional embodiment, as illustrated in FIG. 4, there may be a plurality of the pixel test bonding pads, including a red sub-pixel test bonding pad, a green sub-pixel test bonding pad and a blue sub-pixel test bonding pad. The red sub-pixel test bonding pad, the green sub-pixel test bonding pad and the blue sub-pixel test bonding pad are individually connected to the flexible printed circuit board 310 and connected with the common electrode test bonding pad by short-circuit connections on the flexible printed circuit board 310, such that the NMOS transistor becomes weak ON status in the inactive state of the display device, and the electrical charges generated by the photovoltaic effect may be guided to the GND terminal via the path through the pixel test bonding pads and the short connections, thus reducing the influence caused on the display effect by the residual direct current generated by the photovoltaic effect of a driver integrated circuit 33 or the amorphous-silicon thin-film transistor.

In the present embodiment, the first display test signal inputting part and the second display test signal inputting part are connected to the flexible printed circuit board and connected with each other by short-circuit connections, and the NMOS transistor becomes weak ON status in the inactive state of the display device, so that the electrical charges generated by photovoltaic effect may be inducted to the GND via the path through the first display test signal inputting part and the second display test signal inputting part, thus the influence caused on the display effect by the residual direct current generated by the photovoltaic effect of the driver integrated circuit 33 or the amorphous-silicon thin-film transistor is reduced.

Figure 5:
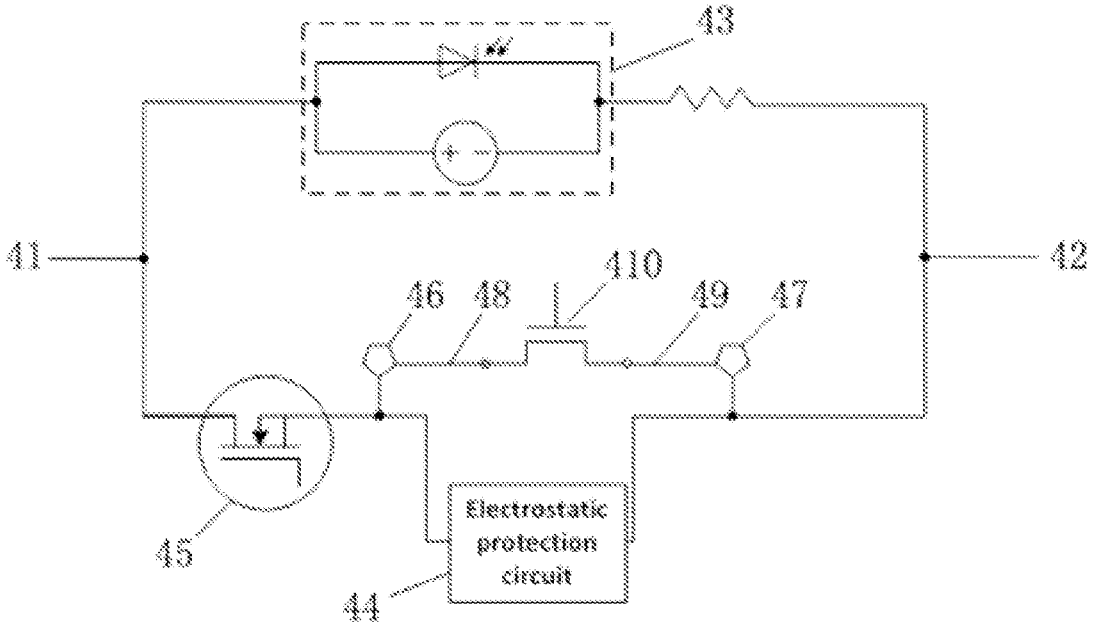
FIG. 5 is a schematic view showing a circuit in a display device according to still another embodiment of the present invention.

FIG. 5 is a schematic view showing a circuit in a display device according to another embodiment of the present invention, and the display device includes a display panel including a first display test signal inputting part 46, a first display test signal controlling part 45, a second display test signal inputting part 37, a first test bus 48, and a second test bus 49.

The first display test signal inputting part 46 is configured to input a first display test signal.

In the present embodiment, the first display test signal inputting part 36 may be a pixel test bonding pad which is configured to input a sub-pixel test signal.

The first display test signal controlling part 45 is configured to control the input of the first display test signal.

In the present embodiment, the first display test signal inputting part 46 is controlled by the first display test signal controlling part 45, the first display test signal controlling part 45 can be an NMOS transistor. The NMOS transistor may be controlled to be turned on or off such that different first display test signals are input by the first display test signal inputting part 46.

The second display test signal inputting part 37 is configured to input a second display test signal.

In the present embodiment, the second display test signal inputting part 47 (such as a common electrode test bonding pad illustrated in FIG. 5) is connected to a common electrode 42 of the display panel and configured to input a common electrode test signal.

The first test bus 48 is connected to the first display test signal inputting part.

The second test bus 49 is connected to the second display test signal inputting part.

The first test bus 48 and the second test bus 49 both included in the display panel are connected with each other via a depletion MOS transistor 410 or a resistor.

It is noted that, as illustrated in FIG. 5, the first display test signal controlling part 45 and the first display test signal inputting part 46 are connected to a common electrode 42 via an electrostatic protection circuit 44, to achieve an electrostatic protection effect on the first display test signal controlling part 45 and the first display test signal inputting part 46.

In the present embodiment, the first display test signal inputting part 46 (such as a pixel test bonding pad illustrated in FIG. 5) is connected to the second display test signal inputting part 47 (such as a common electrode bonding pad illustrated in FIG. 5) via the depletion NMOS transistor 410 or the resistor.

In the present embodiment, there may be a plurality of the first display test signal inputting parts 46, the number of the first display test signal inputting parts 46 corresponds to the number of the base colors of the display device; there may be a plurality of the first test buses 48, including test buses for sub-pixels of the respective base colors, and the plurality of the first display test signal inputting parts are respectively connected to the test buses for sub-pixels of the respective base colors.

In the present embodiment, the plurality of the first display test signal inputting parts 46 may include a red sub-pixel test signal inputting part, a green sub-pixel test signal inputting part and a blue sub-pixel test signal inputting part, and the plurality of the first test buses 48 may include a red sub-pixel signal test bus, a green sub-pixel signal test bus and a blue sub-pixel signal test bus, which are respectively connected to the red sub-pixel test signal inputting part, the green sub-pixel test signal inputting part and the blue sub-pixel test signal inputting part.

In the present embodiment, the second display test signal inputting part 47 may include a common electrode test signal inputting part.

In the present embodiment, the first display test signal controlling part 45 can be an NMOS transistor, a source of which is connected to the first display test signal inputting part 46, and a gate of which is configured to receive the first control signal to turn on or off the NMOS transistor; and the first display test signal inputting part 46 is connected to the common electrode test signal inputting part. When the display device is in displaying, the first control signal is at a low level, such that the NMOS transistor is turned off; and when the display device stops displaying, the first control signal is at a high level, such that the NMOS transistor is turned on.

As illustrated in FIG. 5, when a driver integrated circuit 43 is illuminated by light so that the photovoltaic effect is caused and hence a DC voltage is produced across the common electrode 42 and a data line 41, the DC voltage is directly applied to a pixel and thus generates photovoltaic current due to weak ON status of the amorphous-silicon thin-film transistors. However, the first display test signal inputting part 46 and the second display test signal inputting part 47 are connected with each other via a depletion MOS transistor in the display panel, and the NMOS transistor and the depletion MOS transistor 410 become weak ON status in the inactive state of the display device, so that the electrical charges generated by the photovoltaic effect are inducted to the GND via the path through the first display test signal inputting part 46 and the second display test signal inputting part 47, thus the influence caused on the display effect by the residual direct current generated by the photovoltaic effect of the driver integrated circuit 43 or the amorphous-silicon thin-film transistor is reduced.

In the present embodiment, the first test bus 48 is connected to a first terminal of the depletion MOS transistor 410, the second test bus 49 is connected to a second terminal of the depletion MOS transistor 410, and a gate of the depletion MOS transistor 410 is configured to receive a second control signal to control the depletion MOS transistor 410 to be turned on or off.

In the present embodiment, when the display device is in displaying, the second control signal is at a low level, such that the depletion MOS transistor 410 is turned off; and when the display device stops displaying, the second control signal is at a high level, such that the depletion MOS transistor 410 is turned on.

In the present embodiment, the first terminal of the depletion MOS transistor 410 is a source, and the second terminal of the depletion MOS transistor 410 is a drain; alternatively, the first terminal of the depletion MOS transistor 410 is a drain, and the second terminal of the depletion MOS transistor 410 is a source.

In an optional embodiment, there are a plurality of the pixel test bonding pads, including a red sub-pixel test bonding pad, a green sub-pixel test bonding pad and a blue sub-pixel test bonding pad, each of the pixel test bonding pads is connected to the common electrode test bonding pad via the depletion MOS transistor 410. The source and drain of the depletion MOS transistor 410 are respectively connected to the pixel test bonding pad and the common electrode test bonding pad, and the gate of the depletion MOS transistor 410 is configured to receive the second control signal so that the depletion MOS transistor 410 is turned on in the inactive state of the display device, i.e., in the inactive state of the display device, the gate of the depletion MOS transistor 410 receives a high level, and the gate of the NMOS transistor receives a high level signal to turn on the NMOS transistor, such that the electrical charges generated by the photovoltaic effect are conducted to the GND terminal via the path through the pixel test bonding pad and the common electrode test bonding pad.

In the present embodiment, the first display test signal inputting part and the second display test signal inputting part are connected with each other in the display panel via the depletion MOS transistor, and the NMOS transistor and the depletion MOS transistor become weak ON status in the inactive state of the display device, so that the electrical charges generated by the photovoltaic effect are guided to the GND terminal via such path through the first display test signal inputting part and the second display test signal inputting part, thus the influence caused on the display quality by the residual direct current generated by the photovoltaic effect of a driver integrated circuit or anamorphous-silicon thin-film transistor is reduced.

Figure 6:
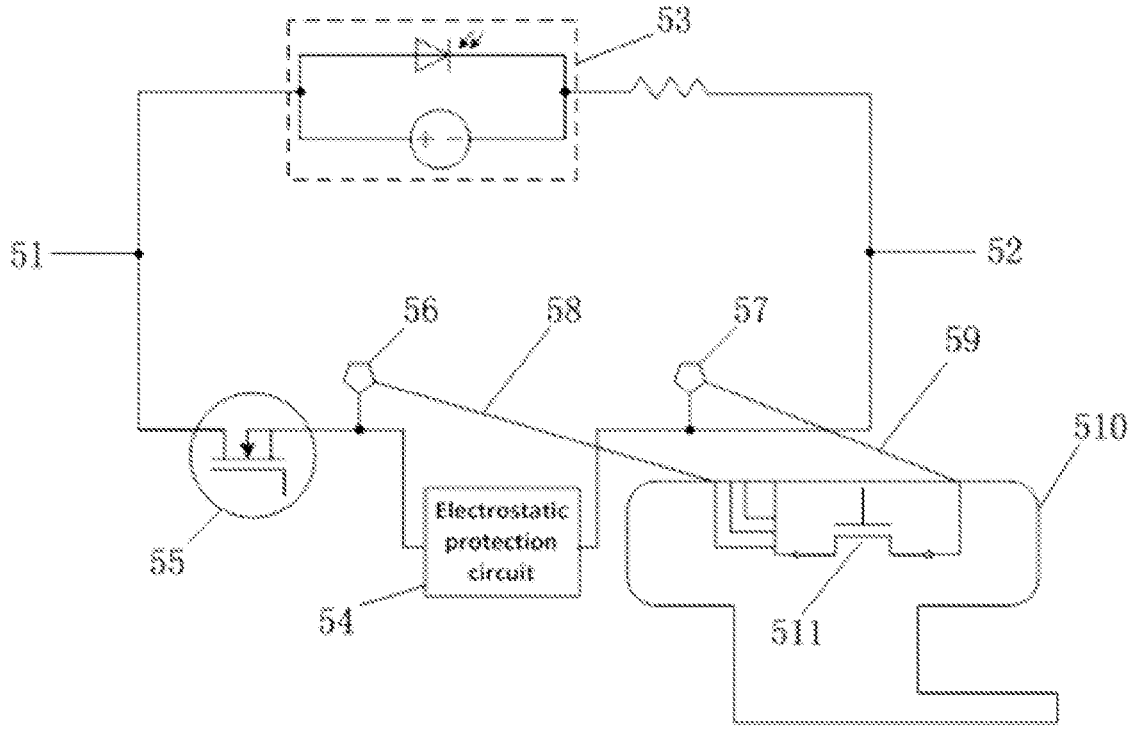
FIG. 6 is a schematic view showing a circuit in a display device according to a yet still another embodiment of the present invention.

FIG. 6 is a schematic view showing a circuit in a display device according to a still another embodiment of the present invention, and the display device includes: a first display test signal inputting part 56, a first display test signal controlling part 55, a second display test signal inputting part 57, a first test bus 58, and a second test bus 59.

The first display test signal inputting part 56 is configured to input a first display test signal.

In the present embodiment, the first display test signal inputting part 56 may be a pixel test bonding pad which is configured to input a sub-pixel test signal.

The first display test signal controlling part 55 is configured to control the input of the first display test signal.

In the present embodiment, the first display test signal inputting part 56 is controlled by the first display test signal controlling part 55, the first display test signal controlling part 55 can be an NMOS transistor. The NMOS transistor may be controlled to be turned on or off such that different first display test signals are input by the first display test signal inputting part 56.

The second display test signal inputting part 57 is configured to input a second display test signal.

In the present embodiment, the second display test signal inputting part 57 (such as a common electrode test bonding pad illustrated in FIG. 6) is connected to a common electrode 52 of the display panel and configured to input a common electrode test signal.

The first test bus 58 is connected to the first display test signal inputting part.

The second test bus 59 is connected to the second display test signal inputting part.

The display device further includes a flexible printed circuit board 510 which includes the first test bus 58 and the second test bus 59 connected with each other via a depletion MOS transistor 511 or a resistor.

It is noted that, as illustrated in FIG. 6, the first display test signal controlling part 55 and the first display test signal inputting part 56 are connected to a common electrode 52 via an electrostatic protection circuit 54, to achieve the electrostatic protection effect on the first display test signal controlling part 55 and the first display test signal inputting part 56.

In the present embodiment, the first display test signal inputting part 56 (such as a pixel test bonding pad illustrated in FIG. 6) is connected to the second display test signal inputting part 57 (such as a common electrode bonding pad illustrated in FIG. 6) via the depletion MOS transistor 510 or the resistor on the flexible printed circuit board of the display device.

In the present embodiment, there may be a plurality of the first display test signal inputting parts 56, the number of the first display test signal inputting parts 56 corresponds to the number of the base colors of the display device; there may be a plurality of the first test buses 58 including test buses for sub-pixels of the respective base colors, and the plurality of the first display test signal inputting parts are respectively connected to the test buses for sub-pixels of the respective base colors.

In the present embodiment, the plurality of the first display test signal inputting parts 56 may include a red sub-pixel test signal inputting part, a green sub-pixel test signal inputting part and a blue sub-pixel test signal inputting part, and the plurality of the first test bus 58 may include a red sub-pixel signal test bus, a green sub-pixel signal test bus and a blue sub-pixel signal test bus, which are respectively connected to the red sub-pixel test signal inputting part, the green sub-pixel test signal inputting part and the blue sub-pixel test signal inputting part.

In the present embodiment, the second display test signal inputting part 57 may include a common electrode test signal inputting part.

In the present embodiment, the first display test signal controlling part 55 can be an NMOS transistor, a source of which is connected to the first display test signal inputting part 56, and a gate of which is configured to receive the first control signal to turn on or off the NMOS transistor; and the first display test signal inputting part 56 is connected to the common electrode test signal inputting part. When the display device is in displaying, the first control signal is at a low level, such that the NMOS transistor is turned off; and when the display device stops displaying, the first control signal is at a high level, such that the NMOS transistor is turned on.

As illustrated in FIG. 6, when a driver integrated circuit 53 is illuminated by light so that the photovoltaic effect is caused and hence a DC voltage is produced across the common electrode 52 and a data line 51, the DC voltage is directly applied to a pixel and thus generates photovoltaic current due to weak ON status of the amorphous-silicon thin-film transistors. However, the first display test signal inputting part 56 and the second display test signal inputting part 57 are connected with each other via the depletion MOS transistor in the display panel, and the NMOS transistor and the depletion MOS transistor 511 become weak ON status in the inactive state of the display device, so that the electrical charges generated by the photovoltaic effect are guided to the GND terminal via such path through the first display test signal inputting part 56 and the second display test signal inputting part 57, thus the influence caused on the display effect by the residual direct current generated by the photovoltaic effect of the driver integrated circuit 53 or the amorphous-silicon thin-film transistor is reduced.

In the present embodiment, the first test bus 58 is connected to a first terminal of the depletion MOS transistor 511, the second test bus 59 is connected to a second terminal of the depletion MOS transistor 511, and a gate of the depletion MOS transistor 511 is configured to receive a second control signal to control the depletion MOS transistor 511 to be turned on or off.

In the present embodiment, when the display device is in displaying, the second control signal is at a low level, such that the depletion MOS transistor 511 is turned off; and when the display device stops displaying, the second control signal is at a high level, such that the depletion MOS transistor 511 is turned on.

In the present embodiment, the first terminal of the depletion MOS transistor 511 is a source, and the second terminal of the depletion MOS transistor 511 is a drain; alternatively, the first terminal of the depletion MOS transistor 511 is a drain, and the second terminal of the depletion MOS transistor 511 is a source.

In an optional embodiment, the pixel test bonding pad includes a red sub-pixel test bonding pad, a green sub-pixel test bonding pad and a blue sub-pixel test bonding pad, which are respectively connected to the common electrode test bonding pad via the depletion MOS transistor 511 on the flexible printed circuit board 510. The source and drain of the depletion MOS transistor 511 are respectively connected to the pixel test bonding pad and the common electrode test bonding pad, and a gate of the depletion MOS transistor 511 is configured to receive the second control signal, so that the depletion MOS transistor 511 is turned on in the inactive state of the display device, i.e., the gate of the depletion MOS transistor 511 receives a high level when the display device is in the inactive state, at the same time, the gate of the NMOS transistor receives a high level to turn on the NMOS transistor, such that the electrical charges generated by the photovoltaic effect is guided to the GND terminal via such path through the pixel test bonding pad and the common electrode test bonding pad.

In the present embodiment, the first display test signal inputting part and the second display test signal inputting part are connected with each other on the flexible printed circuit board via the depletion MOS transistor, and the NMOS transistor and the depletion MOS transistor become weak ON status in the inactive state of the display device, so that the electrical charges generated by the photovoltaic effect are guided to the GND terminal, thus the influence caused on the display effect by the residual direct current generated by the photovoltaic effect of a driver integrated circuit or anamorphous-silicon thin-film transistor is reduced.

Although the embodiments and technical principles adopted therein have been described as above, it is understood by the skilled person in the art that the present invention is not limited to the particular embodiments. The present invention can be changed, modified and replaced by the skilled person in the art without departing from the scope and principle of the present invention. Therefore, though the present invention has been specifically described through the previous embodiments, the present invention is not merely limited to the previous embodiments; more other equivalent embodiments may be made with the concept of the present invention, and the scope of the present invention is defined by the appended claims.

What is claimed is:

1. A display device, comprising:

a driver integrated circuit configured to provide a data signal to a sub-pixel through a data line;

a first display test signal inputting part, configured to input a first display test signal S1 corresponding to the sub-pixel to the data line of the sub-pixel for a testing;

a first display test signal controlling part, configured to control the input of the first display test signal S1 to the data line of the sub-pixel for the testing;

a second display test signal inputting part, configured to input a second display test signal S2 corresponding to a common electrode of the sub-pixel;

a first test bus, connected to the first display test signal inputting part; and a second test bus, connected to the second display test signal inputting part, wherein the first test bus and the second test bus are connected with each other, such that when the sub-pixel is not displaying, electrical charges generated in the driver integrated circuit by a photovoltaic effect are guided to a ground terminal via a path through the first display test signal inputting part and the second display test signal inputting part, wherein the second display test signal inputting part comprises a common electrode test signal inputting part.

2. The display device according to claim 1, further comprising a plurality of first display test signal inputting parts, wherein the number of the first display test signal inputting parts corresponds to the number of base colors of the display device, wherein a plurality of first test buses comprises test buses for sub-pixels of the respective base colors, and wherein the plurality of the first display test signal inputting parts are respectively connected to the test buses for the sub-pixels of the respective base colors.

3. The display device according to claim 2, wherein the plurality of first display test signal inputting parts comprises a red sub-pixel test signal inputting part, a green sub-pixel test signal inputting part and a blue sub-pixel test signal inputting part, wherein a plurality of first test buses comprises a red sub-pixel signal test bus, a green sub-pixel signal test bus, and a blue sub-pixel signal test bus, wherein the red sub-pixel signal test bus, the green sub-pixel signal test bus, and the blue sub-pixel signal test bus are respectively connected to the red sub-pixel test signal inputting part, the green sub-pixel test signal inputting part, and the blue sub-pixel test signal inputting part.

4. The display device according to claim 1, wherein:

the first display test signal controlling part comprises an NMOS transistor, wherein a source of the NMOS transistor is connected to the first display test signal inputting part, and wherein a gate of the NMOS transistor is configured to receive a first control signal to turn on or off the NMOS transistor;

the first display test signal inputting part is connected to the common electrode test signal inputting part;

while the display device is displaying, the first control signal is at a low level, such that the NMOS transistor is turned off; and while the display device is not displaying, the first control signal is at a high level, such that the NMOS transistor is turned on.

5. The display device according to claim 1, further comprising a display panel, wherein the display panel comprises the first test bus and the second test bus.

6. The display device according to claim 1, further comprising a flexible printed circuit board which comprises the first test bus and the second test bus.

7. The display device according to claim 5, wherein the first test bus and the second test bus are connected with each other via a depletion MOS transistor or a resistor.

8. The display device according to claim 6, wherein the first test bus and the second test bus are connected with each other via a depletion MOS transistor or a resistor.

9. The display device according to claim 7, wherein the first test bus is connected to a first terminal of the depletion MOS transistor, the second test bus is connected to a second terminal of the depletion MOS transistor, and a gate of the depletion MOS transistor is configured to receive a second control signal to turn on or off the depletion MOS transistor.

10. The display device according to claim 8, wherein the first test bus is connected to a first terminal of the depletion MOS transistor, the second test bus is connected to a second terminal of the depletion MOS transistor, and a gate of the depletion MOS transistor is configured to receive a second control signal to control the turning on or off of the depletion MO S transistor.

11. The display device according to claim 9, wherein:

while the display device is displaying, the second control signal is at a low level, such that the depletion MOS transistor is turned off; and while the display device is not displaying, the second control signal is at a high level, such that the depletion MOS transistor is turned on.

12. The display device according to claim 10, wherein:

while the display device is displaying, the second control signal is at a low level, such that the depletion MOS transistor is turned off; and while the display device is not displaying, the second control signal is at a high level, such that the depletion MOS transistor is turned on.

13. The display device according to claim 9, wherein:

the first terminal of the depletion MOS transistor is a source, and the second terminal of the depletion MOS transistor is a drain; or the first terminal of the depletion MOS transistor is a drain, and the second terminal of the depletion MOS transistor is a source.

14. The display device according to claim 10, wherein:

the first terminal of the depletion MOS transistor is a source, and the second terminal of the depletion MOS transistor is a drain; or the first terminal of the depletion MOS transistor is a drain, and the second terminal of the depletion MOS transistor is a source.

* * * * *